US007392803B2

(12) United States Patent
Liao

(10) Patent No.: US 7,392,803 B2
(45) Date of Patent: Jul. 1, 2008

(54) FIXING RING STRUCTURE FOR A BARREL OF A TOY GUN

(75) Inventor: Yin-Hsi Liao, Sijhih (TW)

(73) Assignee: Guay Guay Trading Co., Ltd., Taipei County (TW)

( * ) Notice: Subject to any disclaimer, the term of this patent is extended or adjusted under 35 U.S.C. 154(b) by 258 days.

(21) Appl. No.: 11/404,082

(22) Filed: Apr. 14, 2006

(65) Prior Publication Data

US 2007/0240697 A1 Oct. 18, 2007

(51) Int. Cl.
*F41B 11/00* (2006.01)

(52) U.S. Cl. ..... 124/83; 124/73

(58) Field of Classification Search ..... 124/73, 124/74, 83, 84

See application file for complete search history.

(56) References Cited

U.S. PATENT DOCUMENTS 5,630,406 A * 5/1997 Dumont ..... 124/56
6,655,372 B1 * 12/2003 Field et al. ..... 124/83
6,959,509 B2 * 11/2005 Vais ..... 42/75.02
7,076,904 B1 * 7/2006 Rustick ..... 42/75.02

* cited by examiner

*Primary Examiner*—John Ricci
(74) *Attorney, Agent, or Firm*—Troxell Law Office, PLLC

(57) ABSTRACT

A fixing ring structure for a barrel of a toy gun, wherein a fixing portion is disposed center of a gun body corresponding to a fixing ring, and a position fixing hole is defined in a side of the fixing portion for a gas pipe to embed therein. A though hole and a fixing slot are defined in the fixing ring, and a position fixing ring, a position fixing member, a resilient spring piece and a fixing spring piece are disposed in the through hole. The position fixing ring is disposed center of the fixing ring and the position fixing member of the position fixing ring, wherein the position fixing member is rotated using a special tool to disassemble the barrel disposed between the position fixing ring and the sight device, thereby achieving the objective of rapid disassembly, replacement and assembly of the barrel.

2 Claims, 5 Drawing Sheets

FIXING RING STRUCTURE FOR A BARREL OF A TOY GUN

BACKGROUND OF THE INVENTION (a) Field of the Invention

The present invention provides an improved fixing ring structure for a barrel of a toy gun.

(b) Description of the Prior Art

Referring to FIGS. 1 and 2, which show a conventional fixing ring structure for a barrel, wherein a gas pipe A3, a barrel A4 and a fixing ring B are correspondingly disposed between a gun body A1 of a toy gun A and a sight device A2. The fixing ring B is configured with a position fixing ring B1, an elastic body B2 and a fixing piece B3. Furthermore, a position fixing member B4 is formed as a single body of the position fixing ring B1. When disassembling the barrel A4, which penetrates the center of the fixing member B of the toy gun A, the gas pipe A3 disposed between the gun body A1 and the sight device A2 must be first separated from the sight device A2 before the objective of disassembling, replacement and assembling of the barrel A4 can be achieved. However, the fixing ring B1 and position fixing member B4 formed as a single body not only causes inconvenience to the user when assembling and disassembling, moreover, disassembling the barrel A4 and the toy gun A is relatively complicated.

Hence, the inventor of the present invention proposes to resolve and surmount existent technical difficulties to eliminate the aforementioned shortcomings of prior art.

SUMMARY OF THE INVENTION

The present invention provides an improved fixing ring structure for a barrel of a toy gun that includes a position fixing ring of a fixing ring and a position fixing member of the position fixing ring. A special tool is used to rotate the position fixing member of the position fixing ring to disassemble a barrel disposed between the position fixing ring and a sight device without the need to first separate the sight device and a gas pipe, thereby achieving the objective of rapid disassembly, replacement and assembly of the barrel.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
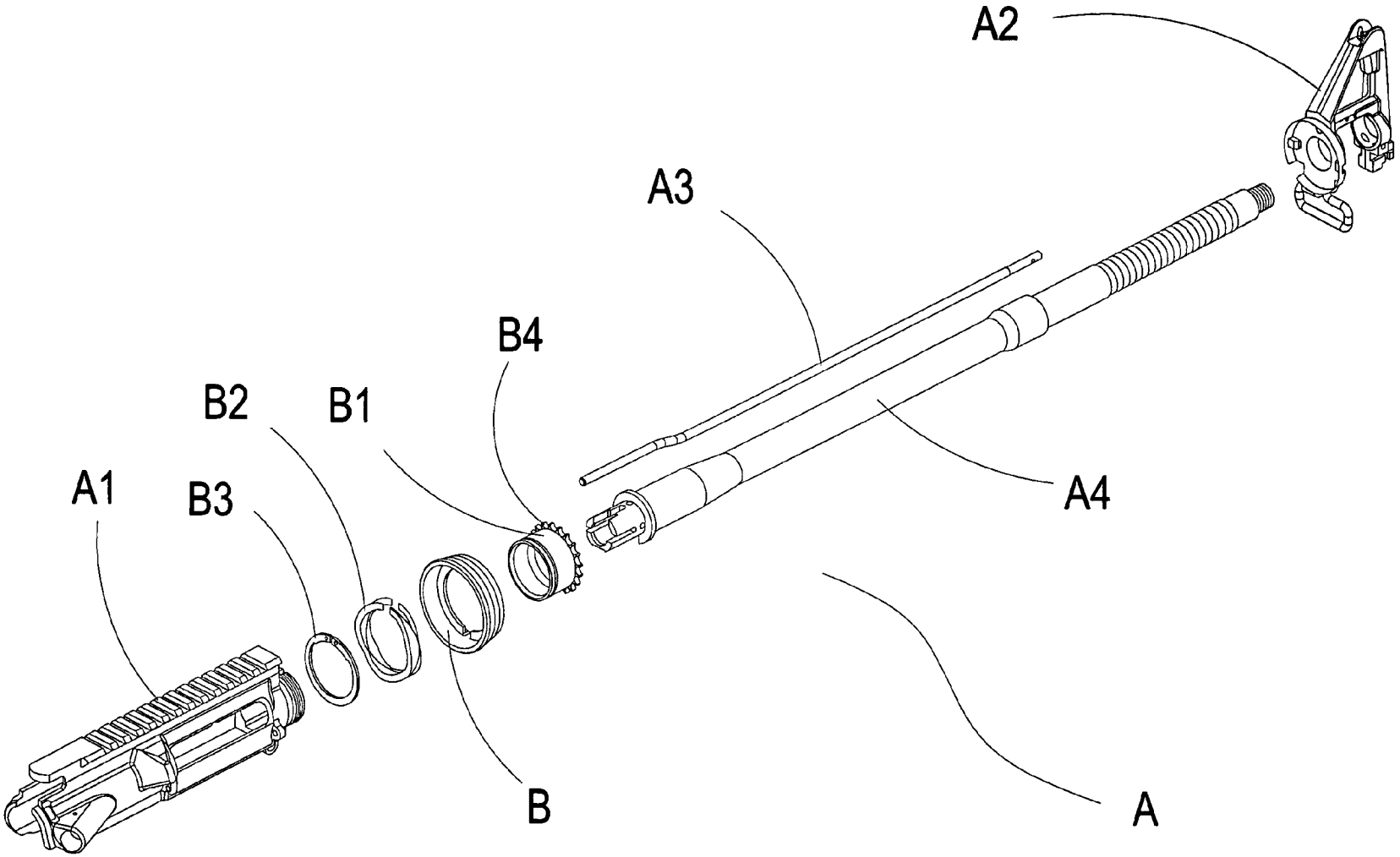
FIG.1 Prior Art
FIG. 1 shows an exploded elevational view of prior art.
Figure 2:
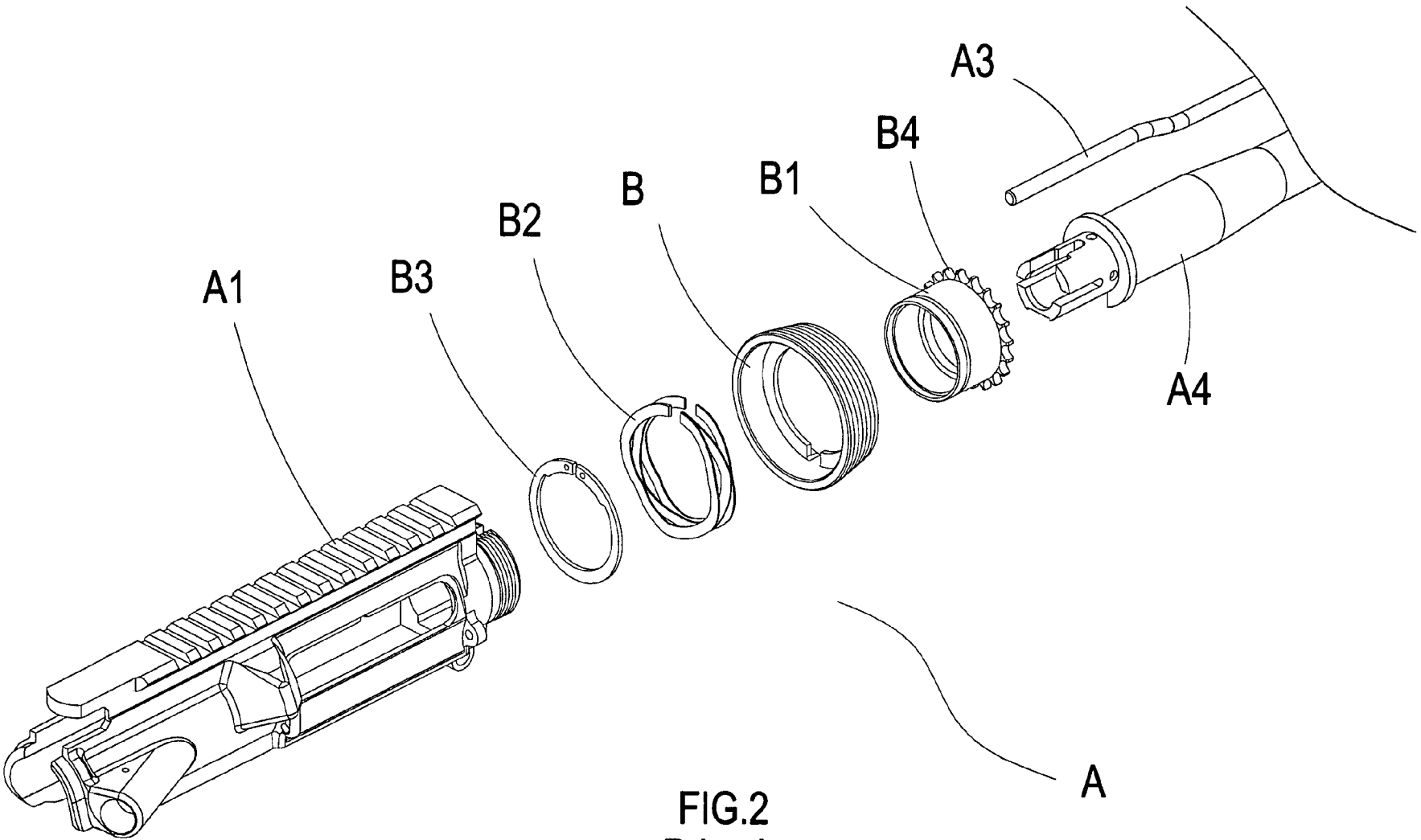
FIG.2 Prior Art
FIG. 2 shows a partial exploded elevational view of prior art.
Figure 3:
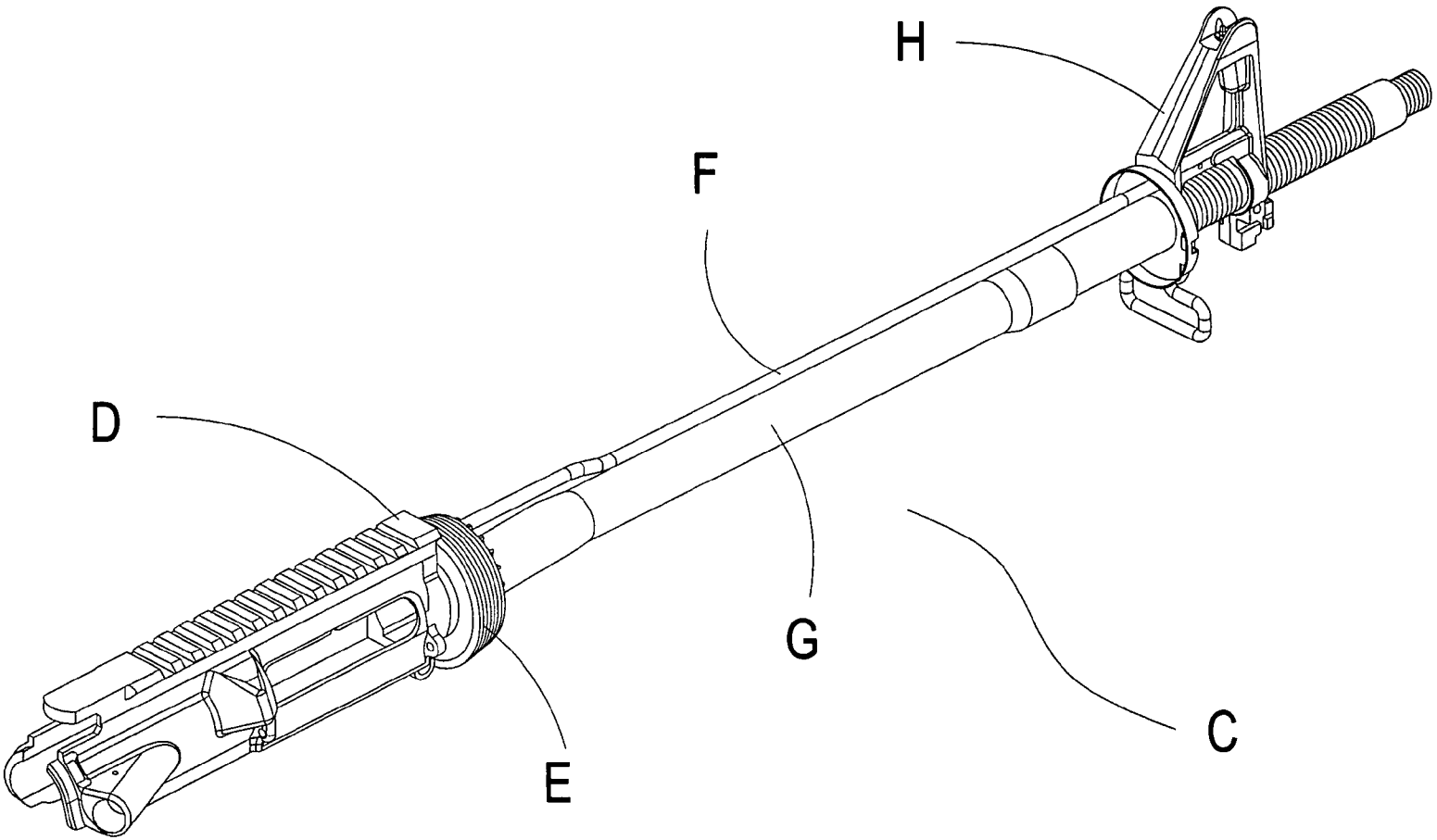
FIG. 3 shows an elevational view according to the present invention.
Figure 4:
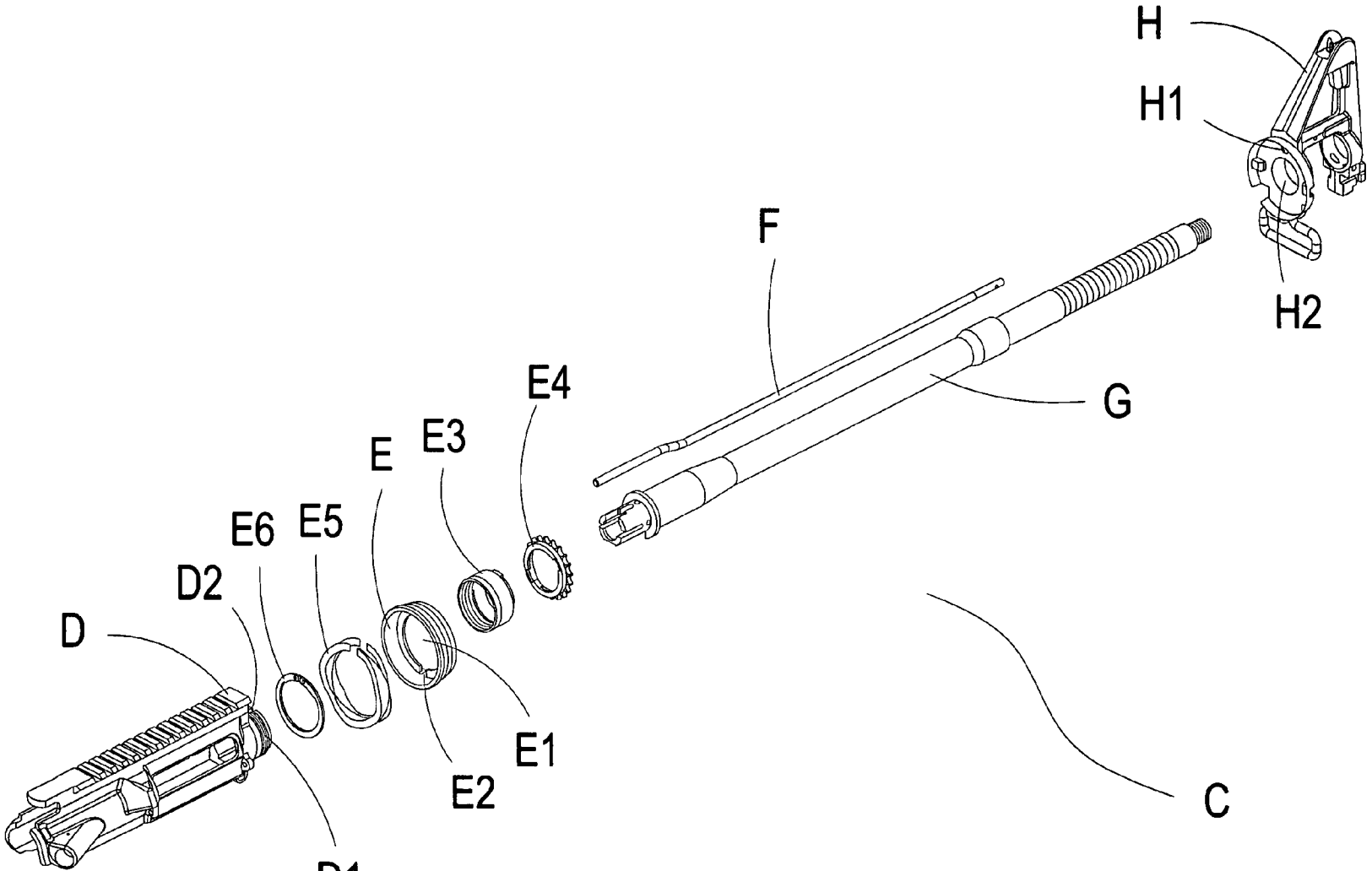
FIG. 4 shows an exploded elevational view according to the present invention.

Referring to FIGS. 3 and 4, which show an improved fixing ring structure for a barrel of a toy gun, comprising a toy gun C including a gun body D, a fixing ring E, a gas pipe F, a barrel G and a sight device H.

The gun body D of the toy gun C is configured with a fixing portion D1, which is inset into the fixing ring E. Furthermore, a position fixing hole D2 is defined in the fixing portion D1 and used to inset the gas pipe F therein.

The fixing ring E is defined with a through hole E1 and a fixing slot E2, and a position fixing ring E3, a position fixing member E4, a resilient spring piece E5 and a fixing spring piece E6 are disposed in the through hole E1.

The position fixing ring E3 and the position fixing member E4 of the fixing ring E serve as a separated fixing structure for the barrel G. Moreover, the fixing slot E2 enables the gas pipe F inset in a side of the sight device H to insert therein.

The gas pipe F is inset in an embedding slot H1 of a side of the sight device H, and the position fixing ring E3 penetrates the center of the fixing ring E and the position fixing hole D2 extending from a side of the gun body D.

An end of the barrel G is disposed in the position fixing ring E3 of the fixing ring E and the position fixing member E4 of a side of the position fixing ring E3, and another end of the barrel G is disposed within a through portion H2 of the sight device H.

The embedding slot H1 defined in the sight device H enables the gas pipe F of one end of the barrel G to be inset therein. Moreover, the through portion H2 defined on a side of the sight device H enables the barrel G to be disposed therein.

The present invention is characterized in the position fixing ring E3 of the fixing ring E and the position fixing member E4 of the position fixing ring E3, wherein the position fixing member E4 is rotated using a special tool to disassemble the barrel G from the position fixing ring E3 and the sight device H, thereby eliminating the need to first separate the sight device H and the gas pipe F, and achieving the objective of rapid disassembly, replacement and assembly of the barrel G.

Figure 5:
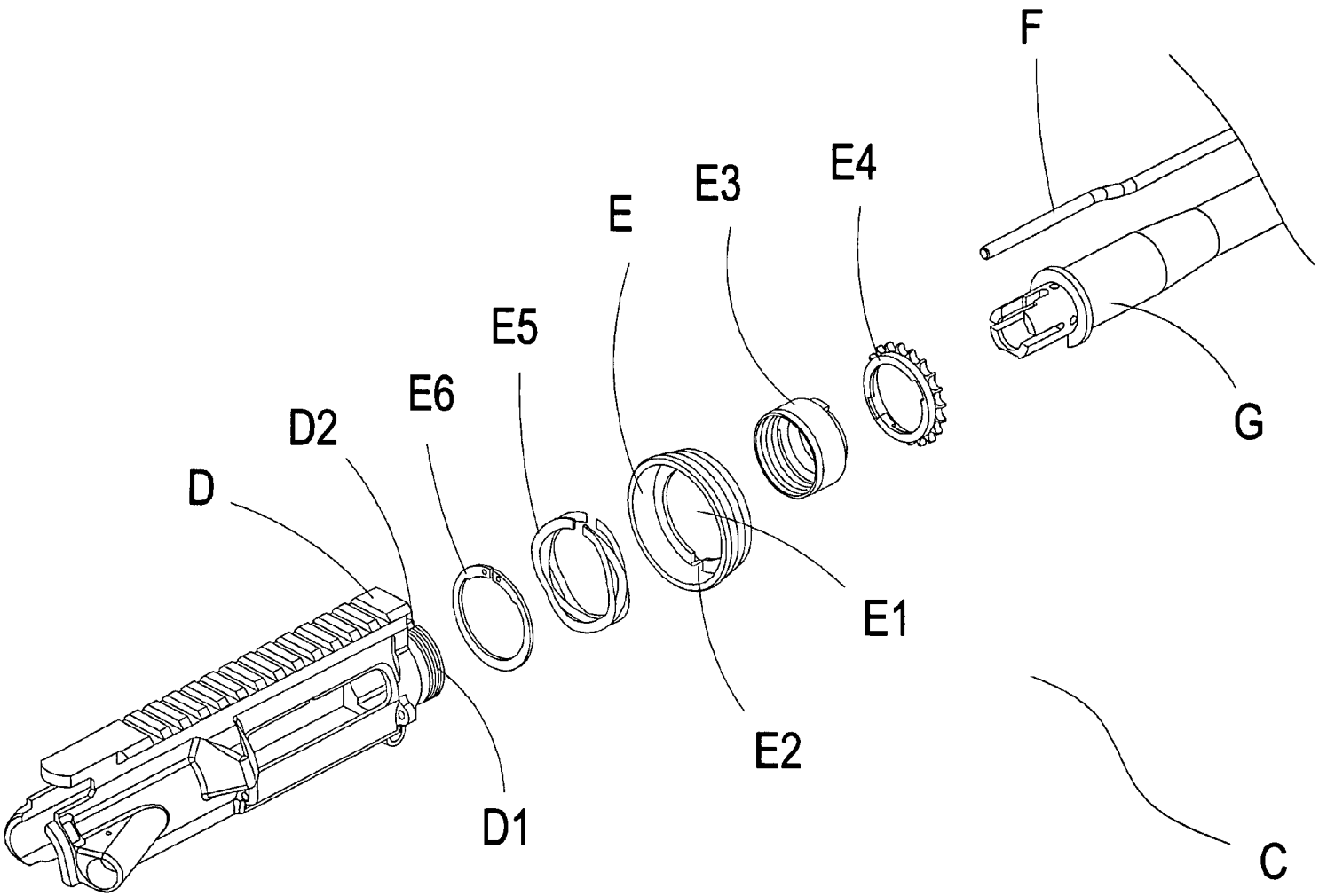
FIG. 5 shows a partial exploded elevational view of an embodiment according to the present invention.

Referring to FIGS. 4 and 5, which show an embodiment of the present invention, wherein the gun body D of the toy gun C is configured with the fixing portion D1, which enables the fixing ring E of the barrel G to be inset therein. Furthermore, the position fixing hole D2 extending from a side of the fixing portion D1 enables the gas pipe F, one end of which is inset in a side of the sight device H, to be inserted therein. The fixing slot E2 of the fixing ring E enables the gas pipe F to be inset therein, and the through hole E1 enables corresponding disposition of the position fixing ring E3, the position fixing member E4, the resilient spring piece E5 and the fixing spring piece E6 therein. Furthermore, the embedding slot H1 of a side of the sight device H enables disposition of one end of the gas pipe F therein, and the penetrating hole H2 enables disposition of the barrel G.

Furthermore, when assembling the gun body D, the fixing ring E, the gas pipe F, the barrel G and the sight device H of the toy gun C, the position fixing ring E3, the position fixing member E4, the resilient spring piece E5 and the fixing spring E6 of the fixing ring E are fixedly joined together to form an integrated body. Moreover, the gas pipe F and the barrel G of the toy gun C is joined to the gun body D when joining together the fixing ring E, the position fixing ring E3 and the position fixing member E4, and the embedding slot H1 and the penetrating hole H2 of a side of the embedding slot H1 enable the gas pipe F and the barrel G to be respectively inset therein.

The position fixing ring E3, the position fixing member E4, the resilient spring piece E5 and the fixing spring piece E6 are disposed in the through hole E1, and the position fixing ring E3 and the position fixing member E4 serve as the separated fixing structure for fixed disposition of the barrel G therein. A special tool is used to rotate the position fixing member E4 to disassemble the barrel G from the position fixing ring E3, thereby eliminating the need to first separate the sight device H and the gas pipe F, and achieving the objective of rapid disassembly, replacement and assembly of the barrel G.

In order to better explicitly disclose advancement and practicability of the present invention, a comparison with prior art is described hereinafter:

Shortcomings of Prior Art

1. A position fixing ring and position fixing member is formed as a single body that fixedly penetrates the center of the fixing ring.

2. Because of shortcoming 1, the gas pipe and sight device must be first separated prior to disassembling the barrel.

3. Shortcoming 2 causes inconvenience to the user when disassembling, replacement and assembling.

4. Because of shortcoming 2, disassembly and handling of the barrel and toy gun is relatively complicated.

Advantages of the Preset Invention

1. The position fixing ring E3 and the position fixing member E4 disposed center of the fixing ring E serve as the separated disassembling structure.

2. Because of advantage 1, there is no need to first separate the gas pipe F and the sight device H in order to disassemble the barrel G.

3. Because of advantage 1, structure of the position fixing ring E3 and the position fixing member E4 achieves the objective of rapid disassembly.

4. Procedure for disassembling and handling of the barrel G and the toy gun C is substantially simple and rapid.

5. Provided with advancement and practicability.

6. Enhances commercial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A fixing ring structure for a barrel of a toy gun, comprising a toy gun including a gun body, a fixing ring, a gas pipe, a barrel and a sight device, wherein the gun body is configured with a fixing portion that enables the fixing ring to inset therein, and a position fixing hole is defined in a side of the fixing portion that enables the gas pipe to inset therein; the fixing ring is defined with a through hole and a fixing slot, and a position fixing ring, a position fixing member, a resilient spring piece and a fixing spring piece are disposed in the through hole, moreover, the fixing slot enables the gas pipe, one end of which is inset in a side of the sight device, to insert therein;

a through portion extending from a side of the sight device enables one end of the barrel to be disposed therein, and another end passes through the position fixing ring and the position fixing member positioned center of the fixing ring; the fixing ring structure for a barrel of a toy gun is characterized in the position fixing ring disposed center of the fixing ring and the position fixing member of the position fixing ring, wherein the position fixing member is rotated using a special tool to disassemble the barrel disposed between the position fixing ring and the sight device, thereby eliminating the need to first separate the sight device and the gas pipe, and achieving the objective of rapid disassembly, replacement and assembly of the barrel.

2. The fixing ring structure for a barrel of a toy gun according to claim 1, wherein the position fixing ring and the position fixing member serve as the separated fixing structure for the barrel, and a special tool is used to rotate the position fixing member of the position fixing ring to disassemble the barrel from the position fixing ring, thus eliminating the need to first separate the sight device and the gas pipe while achieving the objective of rapid disassembly, replacement and assembly, and further simplifying procedure for disassembling and separation of the barrel.

* * * * *